US009010489B1

(12) United States Patent
Edmondson

(10) Patent No.: US 9,010,489 B1
(45) Date of Patent: Apr. 21, 2015

(54) HELIX FIRE ESCAPE STRUCTURE

(71) Applicant: David Lee Edmondson, Menifee, CA (US)

(72) Inventor: David Lee Edmondson, Menifee, CA (US)

( * ) Notice: Subject to any disclaimer, the term of this patent is extended or adjusted under 35 U.S.C. 154(b) by 0 days.

(21) Appl. No.: 14/306,001

(22) Filed: Jun. 16, 2014

Related U.S. Application Data

(60) Provisional application No. 61/838,669, filed on Jun. 24, 2013.

(51) Int. Cl.
*A62B 1/20* (2006.01)
*A62B 5/00* (2006.01)

(52) U.S. Cl.
CPC .... *A62B 1/20* (2013.01); *A62B 5/00* (2013.01)

(58) Field of Classification Search
CPC ..... A62B 1/20
USPC ..... 182/48; 52/187; 193/12, 13; 472/16
See application file for complete search history.

(56) References Cited

U.S. PATENT DOCUMENTS

| | | | | | |
|---|---|---|---|---|---|
| 277,156 | A * | 5/1883 | Parkessus | 182/47 |
| 318,086 | A * | 5/1885 | Clarke | 182/47 |
| 506,238 | A * | 10/1893 | Kirker | 193/12 |
| 849,340 | A * | 4/1907 | Schwab | 193/12 |
| 3,556,522 | A * | 1/1971 | Gale | 472/116 |
| 3,968,856 | A | 7/1976 | Keen et al. | |
| 6,467,575 | B1 | 10/2002 | Chen | |
| 7,048,092 | B2 | 5/2006 | Gomes Junior | |
| 7,789,761 | B1 * | 9/2010 | Lumsden | 472/116 |
| 8,359,677 | B1 | 1/2013 | Mock | |
| 2008/0142297 | A1 * | 6/2008 | Desrosiers | 182/48 |

* cited by examiner

*Primary Examiner* — William Gilbert

(57) ABSTRACT

Improvements in a fire escape having a structure of a Helix/Spiral Cylinder shape. It's a building within a building. It provides a quick and safe evacuation for all fire victims, including the A.D.A., the injured and the elderly. Its spiral design can accommodate a large number of floor levels. It eliminates the hazards acquainted with stairs and elevators. It has the capability of removing some of the smoke from the high-rise fire by way of a metal Ducting System. It draws the smoke into the center smoke shaft. The spiral is a two-way traffic pathway, which offers Fire Department personnel and their equipment a method of upward transportation to any floor-level they need for fighting this fire incident. My design can be retrofitted to any existing building.

9 Claims, 3 Drawing Sheets

HELIX FIRE ESCAPE STRUCTURE

This application is a continuation-in-part of applicant's application Ser. No. 61/838,669 filed Jun. 24, 2013 the entire contents of which is hereby expressly incorporated by reference herein.

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC

Not Applicable

BACKGROUND OF THE INVENTION

Field of the Invention

This invention relates to improvements in a fire escape for a building. More particularly to a fire escape system that uses a helical conveying system to move people from upper floors down the building.

BRIEF SUMMARY OF THE INVENTION

It is an object of the fire escape helix structure to help remove some of the fires smoke from the outer building, by way of its metal ducts. Smoke is drawn into the ducts, then on into the helix inner cylinder. This vacuum system is created by a fan and large blades mounted at the top of the inner cylinder. The vacuum will pull the smoke up to the roof top and then safely out to the open sky above.

It is another object of the fire escape helix structure to provide an egress of fire victims. This invention is a quick and safe escape through the attached doors on each floor level. Once fire victim are inside the helix, they are safe and free from fire and smoke. They can then open an escape tray, mount themselves on the escape tray and ride the helix to the lower basement floor for a quick and safe exit.

It is still another object of the fire escape helix structure to offers Fire Department Personnel quick and safe upward transportation on the two-way traffic Helix. They can exit any floor-level they desire and begin their tasks of fire-fighting without fatigue. They arrive quickly, safely and without fatigue.

Various objects, features, aspects, and advantages of the present invention will become more apparent from the following detailed description of preferred embodiments of the invention, along with the accompanying drawings in which like numerals represent like components.

DETAILED DESCRIPTION OF THE INVENTION

The SAFE helix fire escape has three major components that separates the fire escape from other past inventions.

First to be understood about this invention is that it is a separate building within a high-rise building. It's best noted in the Bible, Book of Ezekiel, Chapter 1, Verse 16—"A WHEEL IN THE MIDDLE OF A WHEEL", This Helix Structure is in the middle of a high-rise building. It should be constructed of concrete, rebar and steel. The Helix starts in the lower basement and rises to the top of the high-rise. It has fire resistant doors at all floor-levels. The Helix has its own utilities and two air pressure systems. One for smoke control and one for positive air pressure, inside the Helix's two-way pathway. This inventor believes it will be best located near elevators, making it quicker and easier for people to find and enter. This same S.A.F.E., Helix Design can also be "Retrofitted", to any existing building.

Smoke kills people, not the fire. This inventions solves much of the smoke problem by removing most of it from the fire incident in the center cylinder of the helix S.A.F.E. is a high powered set of fan blades mounted at the top of the cylinder shaft. This cylinder runs from the basement to above the roof line of the outer high rise building. It is built in the fast turning of these fan blades creating a vacuum system to draw the smoke from the fire incident up into its metal ducting system, then thru the ducts and thru the helix and on into the center cylinder shaft and upward to exit thru its top opening and to the open sky above.

Figure 1:
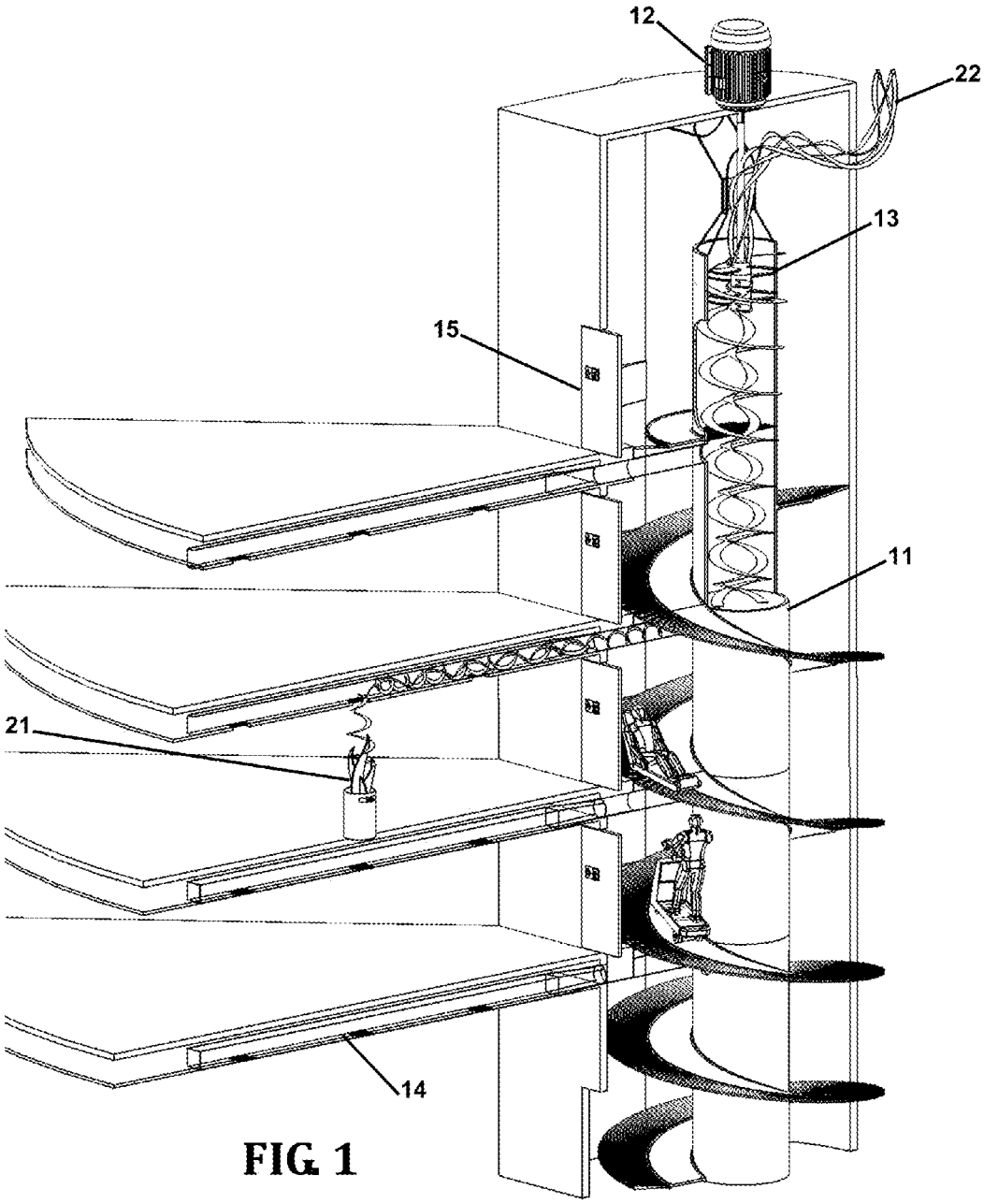
FIG. 1 is a cut-away view of the upper floor-levels of a S.A.F.E., helix structure.

FIG. 1 is a cut-away view of the upper floor-levels of a S.A.F.E., helix structure. The inner shaft 11 is a cylinder, designed to carry smoke. Smoke entering the inner shaft 11 from the metal ducts moves upward to the shafts top and finally out to the open sky above.

The can motor 12 is mounted at the top of the shaft-cylinder is activated by the fire alarms. All helix utilities and air systems are separated from those of the surrounding high-rise building The set of fan blades 13 are designed to create a vacuum system that reaches all the way down to all of the metal ducts. The only ducts that will open and create a vacuum are the floor levels that actually have fire and smoke, otherwise the smoke ducts will stay close not sensing any fire and smoke.

The metal ducts 14 are a part of the smoke removal system. If fire 21 or smoke 22 are detected then that particular floor level of ducts will open and start the vacuum system by pulling some of the smoke into the ducting system. This carries it on into the inner shaft-cylinder where smoke will rise and exit at the top of the helix structure and finally out to the open sky above.

Helix passage doors 15. The doors 15 are constructed of metal to withstand several hours of fire and heat. Each door has a small viewing window for people on either side to look thru. When a person opens the door, positive inside air pressure will push back the fire and smoke, making it easier for fire victims to enter and for fire department personnel to exit these doors and designed to self-close.

Figure 2:
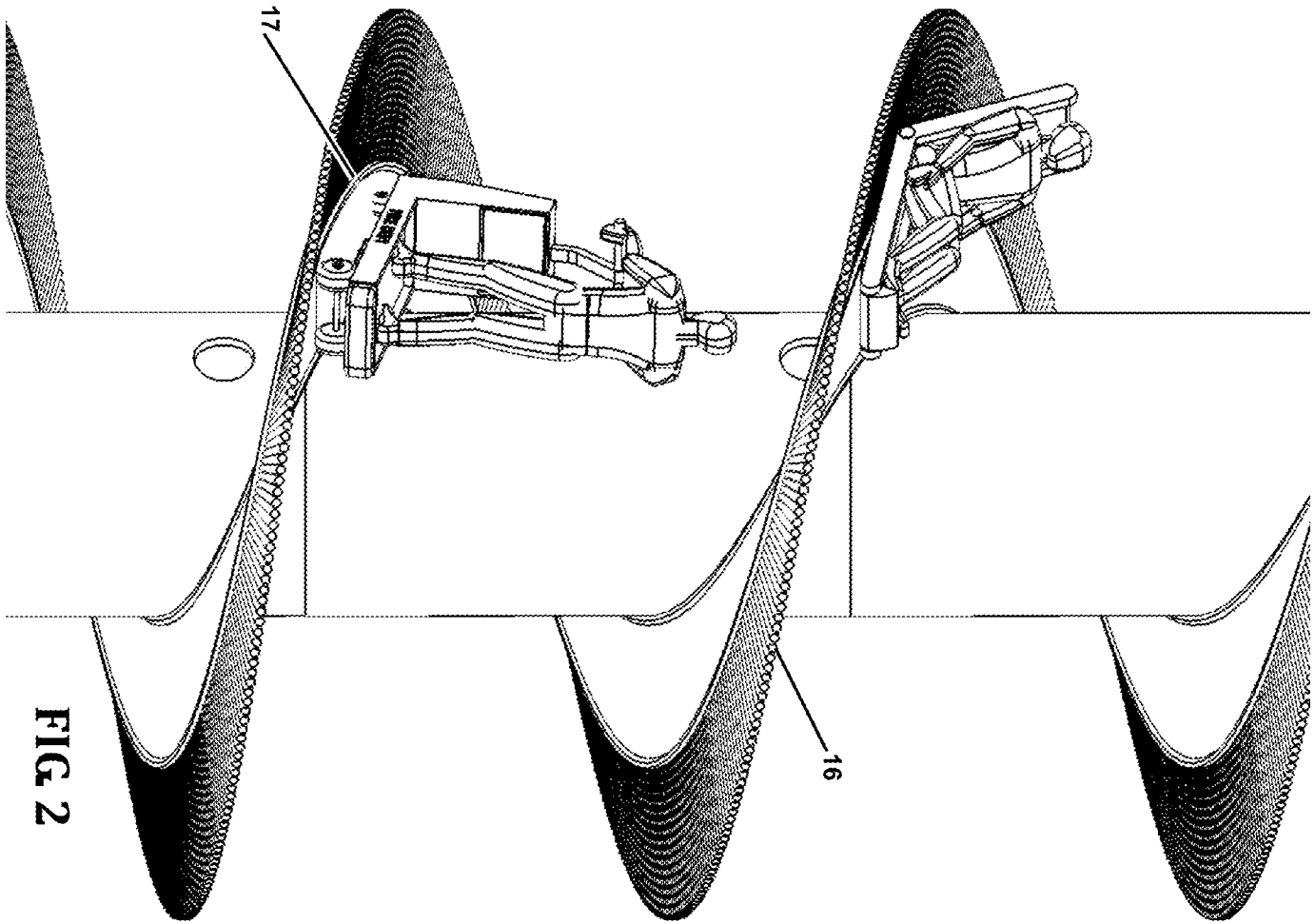
FIG. 2 shows the center cylinder, designed for smoke removal, shown in FIG. 1.

FIG. 2 shows the center cylinder, designed for smoke removal, shown in FIG. 1. The rollers 16 are designed to work like a conveyor belt system, having rollers coated with rubber. This will keep sliding and slipping to a minimum. The rollers will have a "built-in resistance", such as in new toilet seats and in new pick-up truck bed-tailgates "for a sample look as U.S. Pat. No. 8,359,677 by inventor Mock, patent issued on Jan. 29, 2013. The conveyor system will be weight sensitive, thus helping to keep both light and heavy weights going down at safe and same level depending on the building's occupancy levels.

The concrete pathway 17 traveling upward is designed for the fire department personnel. It should be noted that this helix is designed to carry two-way traffic, all at the same time fire victims going down in their escape trays and fire personnel riding their carts upward. They ride to whatever floor-level that best fits their needs for fire-fighting and search and rescue.

Figure 3A:
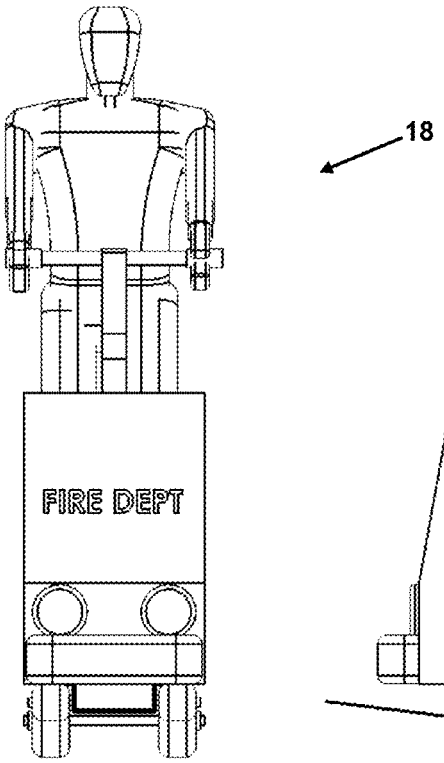
FIGS. 3A and 3B shows a front and side view respectively of a fireman's cart shown in FIG. 1
Figure 3B:
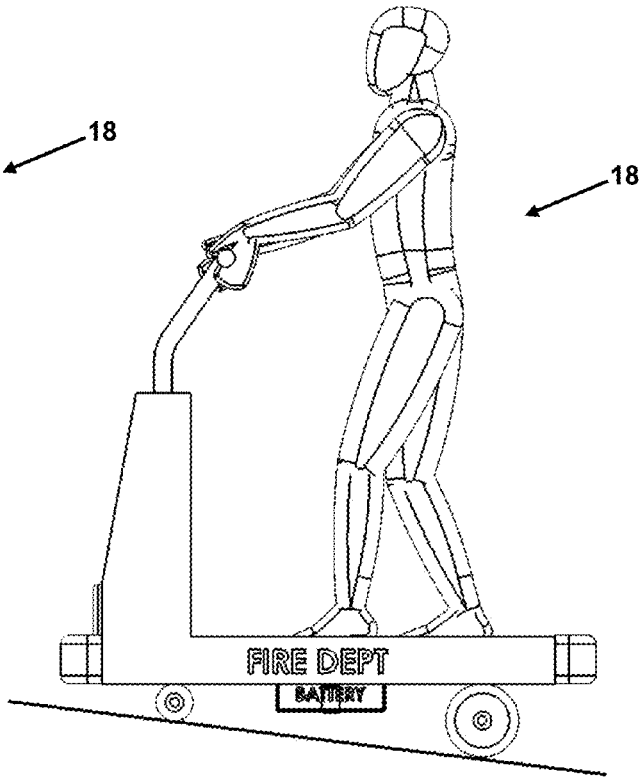

FIGS. 3A and 3B shows a front and side view respectively of a fireman's cart 18 shown in FIG. 1. The fireman's cart 18. They will be restored in the lower basement level of the helix. The carts 18 are designed to aid the fire department personnel. They can be built to run on either battery power or direct electrical power. The carts 18 are designed to carry two-persons and their extra fire equipment. The helix has its own separate utilities and air, power, so the outer structure, the high-rise building cannot effect the helix's ability to run in times of emergency. The helix must remain sovereign, only metal ducts and doors, connect the two structures, separated by a wall of concrete and steel from the lower basement to the top and above the high-rise building it is constructed therein.

Figure 4A:
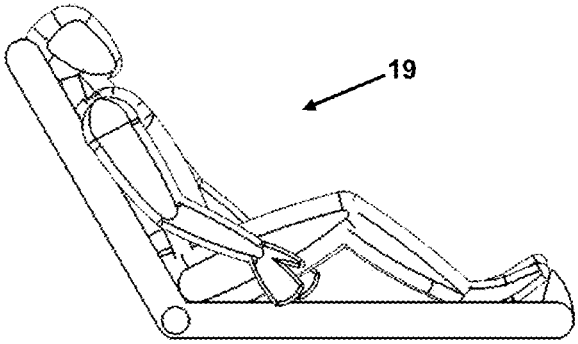
FIGS. 4A and 4B shows a side and front view respectively of an escape tray shown in FIG. 1
Figure 4B:
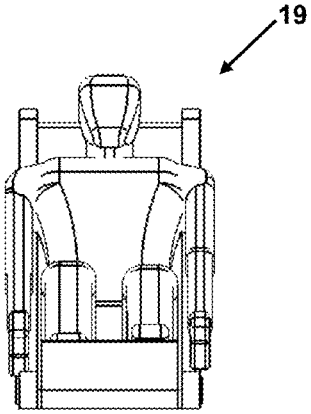

FIGS. 4A and 4B shows a side and front view respectively of an escape tray 19 shown in FIG. 1. The escape trays 19 provide a method of transportation for the fire victims. This includes the A.D.A disabled, elderly and the injured too. The carts are to be made of plastic or fiber materials keeping them simple and light weight. Then any person can lift it, open it, set it on the rollers and climb on it for their ride downward all the way to the lower basement there they exit the helix and walk away to a designed safe holding location, probably outside of the structure.

Egrees/evacuation of fire victims stairs has always been the single method of egress/evacuation for fire victims. Elevators are almost always turned "off" in any fire incident. This leaves all persons only stairs to egress/evacuate left behind is the A.D.A disabled, the injured, and the elderly who cannot walk down many sets of stairs the S.A.F.E helix structure provides a quick, safe and effective methods of egress for all of the fire victims.

When a fire alarm starts ringing, fire victims need only to walk or ride their wheel chairs to the S.A.F.E helix structure, open the S.A.F.E. helix door, enter the helix and the door will self-close behind them instantly they are safe from the fire and smoke once inside the helix they can open an escape tray then ride on it to the bottom floor if the basement, they exit the helix and go to the outside. The other feature of the helix is its "forced air system". The air source is pulled from the outside, through high-powered fans, then upwards throughout the helix when a door is opened to entry or exit the helix, smoke cannot get in the helix because of its positive air pressure, pushing all fire and smoke away from the door openings.

For the first time, "upward transportation for the fire department personnel" they enter the helix in the lower basement floor where they find parked their transport carts to ride on and carry much of their necessary fire equipment. They ride to whatever floor level they feel best meets their needs for fire-fighting or search and rescue purposes. They arrive too late to help those in need of their services. This helix is a two-way traffic design moving people up and downward all at the same time, passing by each other as they travel the helix should be constructed out of concrete and steel materials this leaves nothing to burn. The helix may incorporate many attachments such as emergency lights and numbers on all floor levels, hand rails, electrical outlets as needed, water faucets and fire hose connections, first aid kits, mechanical and battery operated cameras, smoke detectors, sensors and other components as needed for everyone's safety.

The S.A.F.E helix structure is designed for two-way traffic. Person's riding on the helix/spiral can travel both up and downward, all at the same time. The fire victims, including the A.D.A. disabled, injured and elderly can all enter the helix building at all floor levels of the high rise building. Once they are inside the S.A.F.E. helix structure, they can open one of the many stacked escape trays, place the tray on the rollers and mount themselves on the tray and let it carry them safely all the way to the lower basement floor, once there they can exit and safely leave the building. The rollers that the escape trays roll on are designed with rubber coating, to keep all the slippage to a bare minimum. These rollers are built with registers such as in the new toilet seats and the new pick-up truck bed tail gates. The rollers are designed to be weight sensitive. This will keep both the heavy carts and the light weight carts all traveling at about the same safe speed going downward, as used in packaging and shipping conveyors. The S.A.F.E. helix structure is also designed to have its own powered air systems and its own utilities. It is a separate building, within another building, that other building being a high rise structure. The spiral/helix, has positive air pressure during fire incidents, it is created by a powerful fan system located in the basement lower floor. The fresh air is drawn from the outside and ducted into the blower system, then the air is pressurized and pushed upward into the S.A.F.E. helix two-way path. This keeps the helix/spiral holding positive air pressure. When a person opens a door, on any given floor level, smoke or fire cannot enter into the helix because the positive air pressure keeps it out, blowing smoke and flames away from the helix doors. Once fire victims are inside the helix the entry/exit doors, self-close automatically, all of the above mentioned systems will turn on by the same system that triggers the fire alarm.

Thus, specific embodiments of a S.A.F.E helix fire escape have been disclosed. It should be apparent, however, to those skilled in the art that many more modifications besides those described are possible without departing from the inventive concepts herein. The inventive subject matter, therefore, is not to be restricted except in the spirit of the appended claims.

The invention claimed is:

1. A helix fire escape for a building comprising:

an inner shaft having a metal ducting system;

said metal ducting system having an upper end with a motor that removes smoke from a fire below said upper end within a high-rise building;

a fire or smoke detection system;

said inner shaft being connected to a two-way traffic pathway that encircles said inner shaft in a helical relationship;

said two-way traffic pathway further connected to at least one door located at each floor of a high-rise building;

said two-way traffic pathway having a first fixed solid pathway extending substantially the entire longitudinal length of said two-way traffic pathway and a second roller pathway that extends substantially the entire longitudinal length of said two-way traffic pathway in a side-by-side relationship with respect to said first pathway, said second pathway being distal with respect to said first pathway relative to said inner shaft, and said motor connected to a fan having fan blades that create a vacuum in said metal ducting system whereby vacuuming said smoke from hallways within said high-rise building.

2. The helix fire escape from claim 1 wherein said two-way traffic pathway has a first direction for fire department personnel, and carts to transport said fire department personnel upward to a floor where said fire department personnel desire for fire-fighting.

3. The helix fire escape from claim 2 wherein said two-way traffic pathway further includes a second direction for egress from fire within said high-rise building.

4. The helix fire escape from claim 3 wherein said helix fire escape is enclosed within a vertical structure and when people are within said vertical structure, have escape trays that are used with said second direction for egress to use gravity to travel to basement floors.

5. The helix fire escape from claim 1 that further includes at least one cart.

6. The helix fire escape from claim 5 wherein said at least one cart provides a powered mechanism to transport said fire department personnel up said first direction of said two-way traffic pathway.

7. The helix fire escape from claim 1 that further includes at least one sled.

8. The helix fire escape from claim 7 wherein said at least one sled provides for spaced travel of said people for said egress.

9. The helix fire escape from claim 1 wherein said high-rise building has metal ducts that remove smoke from said fire and into said inner shaft.

* * * * *